United States Patent [19]

Corwin

[11] Patent Number: 4,891,183

[45] Date of Patent: Jan. 2, 1990

[54] METHOD OF PREPARING ALLOY COMPOSITIONS

[75] Inventor: John M. Corwin, Royal Oak, Mich.

[73] Assignee: Chrysler Motors Corporation, Highland Park, Mich.

[21] Appl. No.: 938,181

[22] Filed: Dec. 3, 1986

[51] Int. Cl.[4] ..... C22C 1/02; C22C 19/00

[52] U.S. Cl. ..... 420/435; 420/436; 420/441; 420/442; 420/443; 148/4; 148/900; 148/903

[58] Field of Search ..... 420/435, 441, 443, 580, 420/588, 590, 436, 442; 148/4, 900, 903

[56] References Cited

U.S. PATENT DOCUMENTS

| | | | |
|---|---|---|---|
| Re. 24,242 | 12/1956 | Lohr | 75/171 |
| Re. 24,243 | 12/1956 | Lohr | 75/171 |
| Re. 31,339 | 8/1983 | Dardi et al. | 148/4 |
| 648,248 | 5/1900 | Patrick | 420/441 |
| 1,653,630 | 5/1927 | Kiam | 420/588 |
| 1,920,934 | 8/1933 | Keen | 75/1 |
| 1,962,599 | 3/1934 | Keen | 75/1 |
| 3,591,371 | 7/1971 | Hatwell et al. | 420/588 |
| 3,676,085 | 7/1972 | Evans et al. | 420/588 |
| 3,852,063 | 12/1974 | Niimi | 420/40 |
| 3,859,060 | 1/1975 | Eiselstein et al. | 420/443 |
| 3,865,581 | 2/1975 | Sekino et al. | 420/40 |
| 4,022,587 | 5/1977 | Wlodek | 420/443 |
| 4,053,308 | 10/1977 | Tesk et al. | 420/443 |
| 4,094,671 | 6/1978 | Hayashi | 420/587 |
| 4,133,680 | 1/1979 | Babaskin | 420/443 |
| 4,157,923 | 6/1979 | Yen et al. | 148/4 |
| 4,159,908 | 7/1979 | Rao et al. | 420/565 |
| 4,201,577 | 5/1980 | Ingersoll et al. | 420/580 |
| 4,322,248 | 3/1982 | Patrician et al. | 420/429 |
| 4,388,125 | 6/1983 | Benn | 420/443 |
| 4,399,096 | 8/1983 | Agarwal et al. | 420/580 |
| 4,400,209 | 8/1983 | Kudo et al. | 420/452 |
| 4,400,211 | 8/1983 | Kudo et al. | 420/452 |
| 4,411,864 | 10/1983 | Morikawa et al. | 420/587 |
| 4,572,750 | 2/1986 | Masumoto et al. | 420/443 |
| 4,600,556 | 7/1986 | Donachie et al. | 420/542 |
| 4,612,166 | 9/1986 | Brock et al. | 420/490 |
| 4,636,357 | 1/1987 | Peel et al. | 420/532 |
| 4,652,299 | 3/1987 | Bienvenu et al. | 420/590 |
| 4,717,539 | 1/1988 | Morisey | 420/489 |

FOREIGN PATENT DOCUMENTS

| | | | |
|---|---|---|---|
| 0024910 | 2/1980 | Japan . | |
| 0033447 | 4/1981 | Japan . | |
| 0041345 | 4/1981 | Japan . | |
| 2036793 | 7/1980 | United Kingdom | 420/443 |

OTHER PUBLICATIONS

"Understanding Alloys High-Temperature Oxidation Resistance", *MIT Report*, p. 13 (Mar. 1987).

Article entitled: "The Design of Optimum Multifactorial Experiments"; by R. L. Plackett and J. P. Burman from *Biometrika*, 1946, pp. 305-327.

Article entitled: "Some Generalizations in the Multifactorial Design"; by R. L. Plackett from *Biometrika*, 1946, pp. 328-332.

Article entitled: "Table of Percentage Points of the T-Distribution" by E. M. Baldwin from *Biometrika*, 1946, p. 362.

Article entitled: "Industrial Statistics" by W. Volk from *Chemical Engineering*, Mar. 1956.

*Metals Handbook*, Eighth Edition, vol. 2, Lyman, pp. 507-516.

*Materials Science & Engineering*, vol. 70, Appleton et al., pp. 23-51 (1985).

Society of Automotive Engineers (SAE) Paper No. 740093 by A. Roy, F. A. Hagen and J. M. Corwin entitled "Performance of Heat-Resistant Alloys in Emission-Control Systems" (1974).

Dearnaley, G., "Applications of Ion Implantation in Metals and Alloys," *IEEE Transactions on Nuclear Science, Ns-28:2, Apr. 1981.*

*Primary Examiner*—L. Dewayne Rutledge
*Assistant Examiner*—George Wyszomierski
*Attorney, Agent, or Firm*—Mark P. Calcaterra

[57] ABSTRACT

A method of improving the elevated temperature oxidation resistance of non-iron base alloys, especially nickel and cobalt base alloys by the addition of dopants to the oxide scale formed on a broad range of non-iron base alloys such as wrought or cast nickel or cobalt base heat resistant alloys.

66 Claims, 1 Drawing Sheet

$M^+$ = Metal Ion (Cation)
$O^-$ = Oxygen Ion (Anion)
$M$ = Metal Atom
$O$ = Oxygen Atom

METHOD OF PREPARING ALLOY COMPOSITIONS

BACKGROUND OF THE INVENTION

This invention relates to non-iron base alloy compositions and methods and, in a preferred embodiment, to nickel and cobalt base alloys. In a more preferred aspect, this invention relates to compositions and methods employing dopants in nickel and cobalt base alloys as a means of modifying and improving the elevated temperature oxidation resistance of the resulting alloy compositions.

Commerical nickel and cobalt base high temperature alloys resist oxidation attack by forming a protective oxide surface scale during elevated temperature exposure to atmospheres containing oxygen. The protective scale limits the amount of oxygen, as anions, available for reaction with the host alloy. Although this protection is substantial, it is not total and oxidation failure typically occurs by internal oxidation. In one failure mode, grain boundary oxidation leads to rapid deterioration of mechanical properties. A second failure mode involves progressive formation of new oxide at the outer scale surface or the inner scale surface at the interface between the host alloy and scale leading to thick scale growth and eventual spallation. Failure mode in this case is attributed to reduced section thickness as the host alloy is consumed. Often, both of these failure modes operate at the same time.

This invention deals with a cost effective method of improving the protective capacity of oxide scales formed on a broad range of non-iron base alloys such as wrought or cast nickel or cobalt base heat resistant alloys; the present invention also relates to methods of preparing such alloys.

By way of summary, the compositions and methods of the present invention relate to the discovery that certain elements can be added to non-iron base alloy materials to dramatically improve their resistance to oxidation. More particularly, the invention relates to the discovery that the addition of these elements (referred to herein as "dopants") yield lower cost materials suitable for use in heretofore impractical environments.

Accordingly, the compositions and methods of the present invention relate to non-iron base alloy compositions exhibiting improved resistance to oxidation which employ:

(a) a first non-iron metal alloy element;

(b) at least one second non-iron alloy element selected from the group consisting of nickel, chromium, molybdenum, manganese, silicon, carbon, vanadium, cobalt, copper, nitrogen, titanium, zirconium, aluminum and mixtures thereof; wherein said first metal alloy element is present at a weight percent level greater than said second non-iron alloy element; and (c) an effective amount of a dopant selected from the group consisting of lithium, sodium, potassium, yttrium, lanthanum, cerium, calcium, magnesium, barium, aluminum, beryllium, strontium and mixtures thereof.

In a preferred embodiment, the compositions and methods of the present invention employ barium, calcium, lithium, lanthanum/cerium, magnesium potassium and sodium or mixtures thereof are added to the alloy as dopants.

The compositions and methods disclosed herein involve the addition of small quantities of elements appearing, for the most part, in Groups IA, IIA and IIIB of the Periodic Table to the base alloy composition. These elements, as ions, enter into the protective oxide scale and modify predominantly anion and to a lesser extent cation transport through the oxide scale, greatly reducing the amount of oxidation observed due to elevated temperature exposure.

DESCRIPTION OF THE DRAWING

Other objects, features and advantages of the present invention will become more fully apparent from the following detailed description of the preferred embodiment, the appended claims and in the accompanying drawing in which:

DETAILED DESCRIPTION OF THE PREFERRED EMBODIMENT

Figure 1:
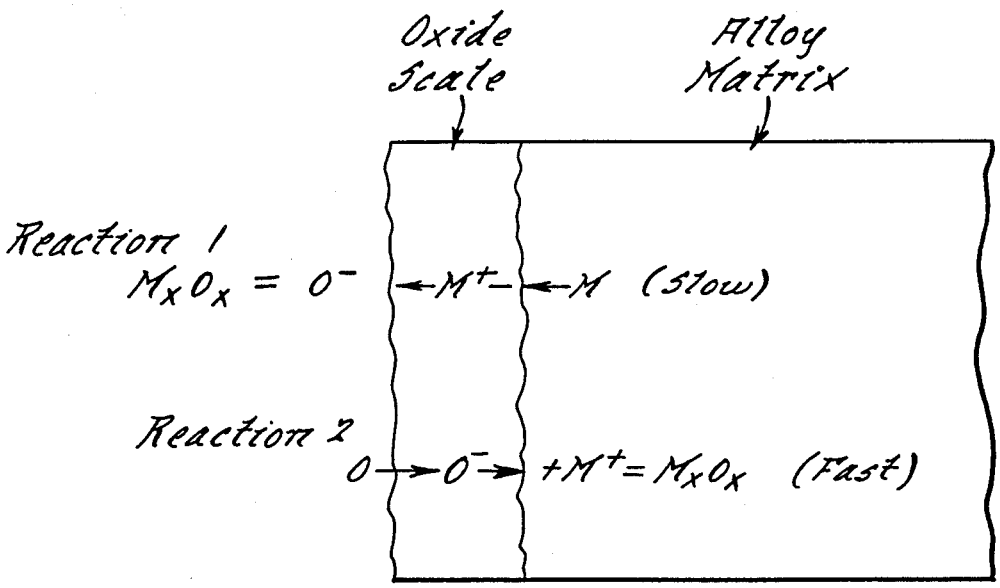
FIG. 1 shows a sketch of ion transport mechanisms typically found in oxidation resistant nickel and cobalt base high temperature alloys, containing chromium as the principle protective scale forming element.

All percentages herein are by weight of the final composition, unless otherwise indicated.

This is one of four applications all filed on the same day. All of the applications deal with related inventions. They are commonly owned and have the same inventor. The claims, drawings and description in each application are unique, but incorporate the others by reference. Accordingly, the following three applications are hereby expressly incorporated by reference: "Oxidation Resistant Iron Base Alloy Compositions"; "Method of Preparing Oxidation Resistant Iron Base Alloy Compositions"; and "Non-Iron Base Alloy Compositions". These are now, respectively, U.S. Ser. No. 938,179; and U.S. Ser. No. 938,180; and U.S. Ser. No. 938,182.

In a preferred aspect, the present invention can basically be described as oxidation resistance alloys having nickel or cobalt as the base material (greatest metal component by weight) additionally employing chromium and/or other alloying elements to increase oxidation resistance. The alloys of this invention contain minor quantities of dopant elements.

Related work is described in an SAE Paper No. 740093 by A. Roy, F. A. Hagen and J. M. Corwin entitled "Performance Of Heat Resistant Alloys In Emission-Control Systems", which is hereby expressly incorporated by reference.

Also hereby expressly incorporated by reference are the following documents: "The Design Of Optimum Multifactorial Experiments" by R. L. Plackett and J. P. Burman (*Biometrika,* 1946, pages 305–327); "Some Generalizations In The Multifactorial Design" by R. L. Plackett (*Biometrika,* 1946, pages 328–332); "Table Of Percentage Points Of The T-Distribution" by Elizabeth M. Baldwin (*Biometrika,* 1946, page 362); and "Industrial Statistics" by W. Volk (*Chemical Engineering,* March, 1956). These are background documents utilized to design the experiments referred to in the above listed SAE Paper No. 740093.

The compositions of the present invention relate to the discovery that certain elements can be added to non-iron base alloy materials to dramatically improve their resistance to oxidation. More particularly, the invention relates to the discovery that the addition of these elements (referred to herein as "dopants") yields materials suitable for use in heretofore impractical environments thereby avoiding the use of expensive, higher alloy-content materials.

The compositions (produced by the methods) of the present invention demonstrate many advantages over art-disclosed compositions including, without limitation, excellent strength retention; and excellent resistance to oxidation under extreme conditions such as high temperatures. Accordingly, they can now be used in environments and applications where undoped materials of similar or identical composition would be impractical or would fail.

The non-iron base alloy compositions of the present invention exhibit improved resistance to oxidation and comprise:

(a) a first non-iron metal alloy element and chromium;

(b) at least one second non-iron alloy element selected from the group consisting of nickel, chromium, molybdenum, manganese, silicon, carbon, vanadium, cobalt, copper, lead, tungsten, columbium, nitrogen and mixtures thereof; wherein said first metal alloy is present at a weight percent level greater than said second alloy element; and (c) an effective amount of a dopant selected from the group consisting of lithium, sodium, potassium, yttrium, lanthanum, cerium, calcium, magnesium, barium, aluminum, beryllium, strontium, and mixtures thereof.

The methods of the present invention relate to preparing a non-iron base alloy composition exhibiting improved resistance to oxidation comprising these steps of:

(a) admixing in a molten state;

(i) a first non-iron metal element;

(ii) at least one second non-iron element selected from the group consisting of nickel, chromium, molybdenum, manganese, silicon, carbon, vanadium, cobalt, copper, nitrogen, titanium, zirconium, aluminum, and mixtures thereof; wherein said first metal alloy is present at weight percent level greater than said second non-iron element;

(iii) an effective amount of a dopant selected from the group consisting of lithium, sodium, potassium, yttrium, lanthanum, cerium, calcium, magnesium, barium, aluminum, beryllium, strontium, and mixtures thereof; and (b) allowing the admixture to cool.

In a preferred embodiment, the compositions and methods of the present invention employ a first non-iron alloy element selected from the group consisting of nickel, chromium, and mixtures thereof.

In a preferred embodiment, the compositions and methods of the present invention employ a second non-iron alloy element selected from the group consisting of silicon, nickel, chromium, cobalt, manganese, nitrogen, and mixtures thereof. Silicon, nickel, chromium, and cobalt are particularly preferred.

In another aspect, the methods of the present invention relate to the preparing of a non-iron base alloy composition exhibiting improved resistance to oxidation comprising the steps of:

(a) providing a non-iron-containing alloy comprising:

(i) a first non-iron alloy element;

(ii) at least one second non-iron element selected from the group consisting of nickel, chromium, molybdenum, manganese, silicon, carbon, vanadium, cobalt, copper, nitrogen, titanium, zirconium, aluminum, and mixtures thereof; and (b) adding to said non-iron-containing alloy an effective amount of a dopant selected from the group consisting of lithium, sodium, potassium, yttrium, lanthanum, cerium, calcium, magnesium, barium, aluminum, beryllium, strontium and mixtures thereof.

Alloy compositions of the present invention would be made in a conventional manner, i.e., typical of the alloy without the dopant of the present invention, but with provision for the addition of dopant elements in the melt process or in the later alloy processing or by surface treatment, the dopant may be added to the surface of the non-iron base alloy by any effective means, or in any conventional manner. For example, the dopant may be added to the surface of the alloy by ion-beam surface modification by laser-induced surface modification or by the diffusion of a surface coating.

Such methods of addition are known in the art. For example, effective method of surface modification and/or surface coating are disclosed in *Metals Handbook*, 8th Edition, Volume 2, Lyman, pages 504–516; and *Materials Science and Engineering*, Volume 70, Appleton, et al., pages 23–51; both of which are hereby expressly incorporated by reference.

The first and second alloy elements are well known in the art, and may be employed at their art-disclosed levels and in their art-disclosed combinations. For example, non-iron base (cobalt base) materials, such as cobalt base super-alloys (both cast and wrought), and nickel-base superalloys (both cast and wrought) may be improved by adding an effective amount of a dopant; while some small adjustment may have to be made to accomodate the addition of a dopant, the balance of the composition materials may be left as generally recognized. For example, cast cobalt-base materials generally known in the art such as types X-40, WI-52, MAR-M-302, MAR-M-332, MAR-M-590, and wrought cobalt-base materials such as S-816, V-36, L-605 (Hayes Alloy 25), J-1570, J-1650, MAR-M-918; as well as nickel-base superalloys such as Inconel 702,706,718,722, X-750 and 751; types 713C,901, B-1900, 0-979, GMR-235-D, Hastelloy alloys S and X, MAR-M-200, MAR-M-246 and MAR-M-421 are representative (but not inclusive) of materials whose properties may be improved by the addition of an effective amount of a dopant of the present invention. The compositions of such material are readily available to those in the art.

Employing the dopants of the present invention, in addition to the elements conventionally employed of such alloys at their art-established levels, produces materials which can then be employed in heretofore impossible or impractical environments or applications.

By the term "non-iron base", as used herein, is meant that some metal element other than iron, preferably nickel or cobalt, is the predominant alloy element present, by weight of the final composition. Thus, while iron may be employed in the compositions or methods of the present invention, it is employed at a level less than the element upon which the alloy is based.

By the term "effective amount", as used herein, it is meant an amount of the dopant sufficient to show a significant and reproducible improvement in one or more oxidation-resistant properties of the final compositions. Such properties would include weight change, surface appearance by gross observation or micro-observation by metallography as described herein. For example, when two alloy compositions differing only in that one contains an effective amount of a dopant and the other contains less than an effective amount (or no dopant) are compared, the alloy containing an effective amount will demonstrate a significant and reproducible improvement in one or more oxidation-resistant properties.

As stated above, the compositions and methods of the present invention employ an effective amount of a dopant. Preferred dopants are primarily selected from the group consisting of elements from Groups IA, IIA and IIIB of the Periodic Table of Elements. These include lithium, sodium, potassium, yttrium, lanthanum, cerium, calcium, magnesium, barium, aluminum, beryllium and strontium. Mixtures of such materials may also be employed. The preferred materials include lithium, sodium, potassium, yttrium, lanthanum, cerium, calcium, magnesium, barium, aluminum and mixtures thereof.

Preferred mixtures include magnesium and calcium with lithium, sodium, and potassium; lithium and sodium; and lithium and potassium.

As stated, the dopant is employed in the compositions and methods of the present invention in an effective amount. Such a level will vary with many factors, including, without limitation, the level of the various other elements, materials, or impurities present, such as nickel, chromium, iron, and the like, as well as the desired improvement in oxidation resistance. The selection of such a level is well within the skill of the artisan in light of the present disclosure and teachings.

In general, the dopant is employed in the compositions and methods of the present invention at a level of at least about 0.02, by weight of the final composition.

In a preferred embodiment, the dopant is present at a level of about 0.05 to about 5 percent; still more preferably at a level of about 0.1 to about 3.5 percent; and still more preferably at a level of about 0.1 to about 2.0 percent.

In a highly preferred embodiment, the dopant employed comprises magnesium, calcium, lithium, sodium and potassium; the magnesium is present at a level of about 0.1 to 1.5 percent; the calcium is present at a level of about 0.1 to 1.5 percent; the lithium is present at a level of about 0.1 to 0.5 percent; the sodium is present at a level of about 0.1 to 0.5 percent; the potassium is present at a level of about 0.1 to 1.0 percent.

It should be noted that aluminum can play many roles in the compositions of the present invention. It can be used as an effective dopant when employed at levels below its general art-established level.

In the description of the alloying and doping agents hereinafter, all percentages are by weight unless specifically noted.

Those skilled in the art realize that commerical alloys of the type considered herein (e.g.: Inconel 600,601, Udimet 700, R-41, In100, Inconel X750, Hastelloy X, Haynes 188 and X40) can undergo at least two types of oxidation reactions when exposed to elevated temperatures in the presence of oxygen containing atmospheres. FIG. 1 diagrams each of these reactions. Reaction 1 involves outward metal ion (cation) migration from the host alloy substrate through the protective oxide scale where reaction takes place with oxygen at or near the outer surfaces of the scale to form new metal oxide or scale. This is referred to as external oxidation.

Diffusion rates of typical scale forming metal ions, or cations, is relatively slow contrasted with oxygen diffusion and the consequences are generally not as damaging to the alloy's mechanical properties as is internal oxidation.

Reaction 2 of FIG. 1, termed internal oxidation, involves oxygen diffusion through the oxide scale leading to combination with host alloy elements to form internal oxides. Because diffusion rates are typically fast along host alloy grain boundaries, internal oxidation is often manifested as grain boundary oxidation which can cause substantial degradation of the alloy's mechanical properties. Major reaction between oxygen ions and the host alloy at the scale/alloy interface contributes to rapid scale growth and reduced metal thickness. The consequence of either of these events is loss of load carrying capacity.

A preferred embodiment would contain, in addition to the standard alloy elements at their art-established levels, one or more of the following as weight percents: 0.6% Mg, 1% Ca, 0.75% Ba, 0.35% Na, 0.3%, li, 0.6% K and 0.5% La—Ce.

While the present invention has been disclosed in connection with the preferred embodiment thereof, it should be understood that there may be other embodiments which fall within the spirit and scope of the invention and that the invention is susceptible to modification, variation and change without departing from the proper scope or fair meaning of the following claims.

I claim:

1. A method of improving the oxidation resistance of an existing crystalline nickel-based alloy composition, comprising the steps of:

(a) providing an existing crystalline nickel-based alloy comprising:
  (i) nickel;
  (ii) chromium; and
  (iii) at least one additional alloy element selected from the group consisting of nickel, chromium, molybdenum, manganese, silicon, carbon, vanadium, cobalt, copper, nitrogen, titanium, zirconium, aluminum, and mixtures thereof, wherein any addition of nickel from said group includes a further addition of a second element selected from said group; and (b) adding to said nickel-base alloy a dopant selected from the group consisting of lithium, sodium, potassium, and mixtures thereof, said dopant being added in an amount sufficient to show a significant and reproducible improvement in one or more oxidation resistant properties of the final composition of said nickel-based alloy.

2. A method according to claim 1, wherein the dopant is added to the surface of the nickel-based alloy.

3. A method according to claim 2 wherein the dopant is added by ion-beam surface modification.

4. A method according to claim 2 wherein the dopant is added by laser induced surface modification.

5. A method according to claim 2 wherein the dopant is added by the diffusion of a surface coating.

6. A method of improving the oxidation resistance of a crystalline nickel-based alloy, comprising the steps of:

(a) admixing in a molten state;
  (i) nickel;
  (ii) chromium; and
  (iii) at least one additional alloy element selected from the group consisting of nickel, chromium, molybdenum, manganese, silicon, carbon, vanadium, cobalt, copper, nitrogen, titanium, zirconium, aluminum, and mixtures thereof, wherein any addition of nickel from said group includes a further addition of a second element selected from said group; and (iv) a dopant selected from the group consisting of lithium, sodium, potassium, and mixtures thereof, said dopant being present in an amount sufficient to show a significant and reproducible improvement in one or more oxidation resistant properties of the final composition of said nickel-based alloy; and (b) allowing the admixture to cool.

7. A method according to claim 6 wherein the additional alloy element is selected from the group consisting of silicon, nickel, chromium, cobalt, manganese, nitrogen and mixtures thereof.

8. A method according to claim 6 wherein the dopant is present at a level of at least 0.02 percent, by weight of the final composition.

9. A method according to claim 8 wherein the dopant is present at a level of about 0.05 percent to about 5 percent, by weight of the final composition.

10. A method according to claim 9 wherein the dopant is present at a level of about 0.1 percent to about 3.5 percent, by weight of the final composition.

11. A method according to claim 10 wherein the dopant is present at a level of about 0.1 percent to about 2.0 percent, by weight of the final composition.

12. A method according to claim 8 wherein the dopant consists essentially of lithium.

13. A method according to claim 8 wherein the dopant consists essentially of sodium.

14. A method according to claim 8 wherein the dopant consists essentially of potassium.

15. A method of improving the oxidation resistance of a crystalline nickel-based alloy, comprising the steps of:

(a) admixing in a molten state;

(i) nickel;

(ii) chromium;

(iii) at least one additional alloy element selected from the group consisting of nickel, chromium, molybdenum, manganese, silicon, carbon, vanadium, cobalt, copper, nitrogen, titanium, zirconium, aluminum, and mixtures thereof, wherein any addition of nickel from said group includes a further addition of a second element selected from said group; and (iv) a mixture of dopants comprising magnesium and one or more additional dopants selected from the group consisting of lithium, sodium, potassium, and mixtures thereof, said dopant mixture being present in an amount sufficient to show a significant and reproducible improvement in one or more oxidation resistant properties of the final composition of said nickel-based alloy; and (b) allowing the admixture to cool.

16. A method according to claim 15 wherein the additional alloy element is selected from the group consisting of silicon, cobalt, manganese, nitrogen, and mixtures thereof.

17. A method according to claim 15 wherein the dopant mixture is present at a level of at least 0.02 percent, by weight of the final composition.

18. A method according to claim 17 wherein the dopant mixture is present at a level of about 0.05 percent to about 5 percent, by weight of the final composition.

19. A method according to claim 18 wherein the dopant mixture is present at a level of about 0.1 percent to about 3.5 percent, by weight of the final composition.

20. A method according to claim 19 wherein the dopant mixture is present at a level of about 0.1 percent to about 2.0 percent, by weight of the final composition.

21. A method according to claim 15 wherein the dopant mixture consists essentially of magnesium and lithium.

22. A method according to claim 15 wherein the dopant mixture consists essentially of magnesium and sodium.

23. A method according to claim 15 wherein the dopant mixture consists essentially of magnesium and potassium.

24. A method of improving the oxidation resistance of a crystalline nickel-based alloy, comprising the steps of:

(a) admixing in a molten state;

(i) nickel;

(ii) chromium;

(iii) at least one additional alloy element selected from the group consisting of nickel, chromium, molybdenum, manganese, silicon, carbon, vanadium, cobalt, copper, nitrogen, titanium, zirconium, aluminum, and mixtures thereof, wherein any addition of nickel from said group includes a further addition of a second element selected from said group; and (iv) a mixture of dopants comprising magnesium, calcium and one or more additional dopants selected from the group consisting of lithium, sodium, potassium, and mixtures thereof, said dopant mixture being present in an amount sufficient to show a significant and reproducible improvement in one or more oxidation resistant properties of the final composition of said nickel-based alloy; and (b) allowing the admixture to cool.

25. A method according to claim 24 wherein the additional alloy element is selected from the group consisting of silicon, nickel, chromium, cobalt, manganese, nitrogen and mixtures thereof.

26. A method according to claim 24 wherein the dopant mixture is present at a level of at least 0.02 percent, by weight of the final composition.

27. A method according to claim 24 wherein the dopant mixture is present at a level of about 0.05 percent to about 5 percent, by weight of the final composition.

28. A method according to claim 27 wherein the dopant mixture is present at a level of about 0.1 percent to about 3.5 percent, by weight of the final composition.

29. A method according to claim 28 wherein the dopant mixture is present at a level of about 0.1 percent to about 2.0 percent, by weight of the final composition.

30. A method according to claim 24 wherein the dopant mixture consists essentially of magnesium, calcium, and lithium, and wherein the magnesium is present at a level of about 0.1 to about 0.5 percent, the calcium is present at a level of about 0.1 to about 0.5 percent, and the lithium is present at a level of about 0.1 to about 0.5 percent by weight of the final composition.

31. A method according to claim 24 wherein the dopant mixture consists essentially of magnesium, calcium and sodium, and wherein the magnesium is present at a level of about 0.1 to about 0.5 percent, the calcium is present at a level of about 0.1 to about 0.5 percent, and the sodium is present at a level of about 0.1 to about 0.5 percent by weight of the final composition.

32. A method according to claim 24 wherein the dopant mixture consists essentially of magnesium, calcium and potassium, and wherein the magnesium is present at a level of about 0.1 to about 0.5 percent, the calcium is present at a level of about 0.1 to about 0.5 percent, and the potassium is present at a level of about 0.1 percent to about 1.0 percent, by weight of the composition.

33. A method according to claim 24 wherein the dopant consists essentially of magnesium, calcium, lithium, sodium and potassium, and wherein said magnesium is present at a level of about 0.1 to about 0.5 percent, said calcium is present at a level of about 0.1 to about 0.5 present, said lithium is present at a level of about 0.1 to about 0.5 percent, said sodium is present at a level of about 0.1 percent to about 0.5 percent, and said potassium is present at a level of about 0.1 percent to about 1.0 percent, by weight of the final composition.

34. A method of improving the oxidation resistance of an existing crystalline cobalt-based alloy composition, comprising the steps of:

(a) providing an existing crystalline cobalt-based alloy comprising:
  (i) cobalt;
  (ii) chromium; and
  (iii) at least one additional alloy element selected from the group consisting of nickel, chromium, molybdenum, manganese, silicon, carbon, vanadium, cobalt, copper, nitrogen, titanium, zirconium, aluminum, and mixtures thereof, wherein any addition of cobalt from said group includes a further addition of a second element selected from said group; and (b) adding to said cobalt-base alloy a dopant selected from the group consisting of lithium, sodium, potassium, and mixtures thereof, said dopant being added in an amount sufficient to show a significant and reproducible improvement in one or more oxidation resistant properties of the final composition of said cobalt-based alloy.

35. A method according to claim 34 wherein the additional alloy element is selected from the group consisting of silicon, nickel, chromium, cobalt manganese, nitrogen and mixtures thereof.

36. A method according to claim 34 wherein the dopant is present at a level of at least 0.02 percent, by weight of the final composition.

37. A method according to claim 36 wherein the dopant is present at a level of about 0.05 percent to about 5 percent, by weight of the final composition.

38. A method according to claim 37 wherein the dopant is present at a level of about 0.1 percent to about 3.5 percent, by weight.

39. A method according to claim 38 wherein the dopant is present at a level of about 0.1 percent to about 2.0 percent, by weight of the final composition.

40. A method according to claim 36 wherein the dopant consists essentially of lithium.

41. A method according to claim 36 wherein the dopant consists essentially of sodium.

42. A method according to claim 36 wherein the dopant consists essentially of potassium.

43. A method of improving the oxidation resistance of a crystalline cobalt-based alloy, comprising the steps of:

(a) admixing in a molten state;
  (i) cobalt;
  (ii) chromium;
  (iii) at least one additional alloy element selected from the group consisting of nickel, chromium, molybdenum, manganese, silicon, carbon, vanadium, cobalt, copper, nitrogen, titanium, zirconium, aluminum, and mixtures thereof, wherein any addition of cobalt from said group includes a further addition of a second element selected from said group; and
  (iv) a dopant selected from the group consisting of lithium, sodium, potassium, and mixtures thereof, said dopant being present in an amount sufficient to show a significant and reproducible improvement in one or more oxidation resistant properties of the final composition of said cobalt-based alloy; and (b) allowing the admixture to cool.

44. A method according to claim 43 wherein the additional alloy element is selected from the group consisting of silicon, nickel, chromium manganese, nitrogen, and mixtures thereof.

45. A method according to claim 43 wherein the dopant mixture is present at a level of at least 0.02 percent, by weight of the final composition.

46. A method according to claim 45 wherein the dopant mixture is present at a level of about 0.05 percent to about 5 percent, by weight of the final composition.

47. A method according to claim 46 wherein the dopant mixture is present at a level of about 0.1 percent to about 3.5 percent, by weight of the final composition.

48. A method according to claim 47 wherein the dopant mixture is present at a level of about 0.1 percent to about 2.0 percent, by weight of the final composition.

49. A method according to claim 43 wherein the dopant mixture consists essentially of magnesium and lithium.

50. A method according to claim 43 wherein the dopant mixture consists essentially of magnesium and sodium.

51. A method according to claim 43 wherein the dopant mixture consists essentially of magnesium and potassium.

52. A method of improving the oxidation resistance of a crystalline cobalt-based alloy, comprising the steps of:

(a) admixing in a molten state;
  (i) cobalt;
  (ii) chromium;
  (iii) at least one additional alloy element selected from the group consisting of nickel, chromium, molybdenum, manganese, silicon, carbon, vanadium, cobalt, copper, nitrogen, titanium, zirconium, aluminum, and mixtures thereof, wherein any addition of cobalt from said group includes a further addition of a second element selected from said group; and
  (iv) a mixture of dopants comprising magnesium and one or more additional dopants selected from the group consisting of lithium, sodium, potassium, and mixtures thereof, said dopant mixture being present in an amount sufficient to show a significant and reproducible improvement in one or more oxidation resistant properties of the final composition of said cobalt-based alloy; and (b) allowing the admixture to cool.

53. A method according to claim 52 wherein the dopant is added to the surface of the cobalt-based alloy.

54. A method according to claim 53 wherein the dopant is added by ion-beam surface modification.

55. A method according to claim 53 wherein the dopant is added by laser induced surface modification.

56. A method according to claim 53 wherein the dopant is added by diffusion of a surface coating.

57. A method of improving the oxidation resistance of a crystalline cobalt-based alloy, comprising the steps of:

(a) admixing in a molten state;

(i) cobalt;

(ii) chromium;

(iii) at least one additional alloy element selected from the group consisting of nickel, chromium, molybdenum, manganese, silicon, carbon, vanadium, cobalt, copper, nitrogen, titanium, zirconium, aluminum, and mixtures thereof, wherein any addition of nickel from said group includes a further addition of a second element selected from said group; and (iv) a mixture of dopants comprising magnesium, calcium and one or more additional dopants selected from the group consisting of lithium, sodium, potassium, and mixtures thereof, said dopant mixture being present in an amount sufficient to show a significant and reproducible improvement in one or more oxidation resistant properties of the final composition of said cobalt-based alloy; and (b) allowing the admixture to cool.

58. A method according to claim 57 wherein the additional alloy element is selected from the group consisting of silicon, nickel, chromium, cobalt, nitrogen and mixtures thereof.

59. A method according to claim 57 wherein the dopant mixture is present at a level of at least 0.02 percent, by weight of the final composition.

60. A method according to claim 57 wherein the dopant mixture is present at a level of about 0.05 percent to about 5 percent, by weight of the final composition.

61. A method according to claim 60 wherein the dopant mixture is present at a level of about 0.1 percent to about 3.5 percent, by weight of the final composition.

62. A method according to claim 61 wherein the dopant mixture is present at a level of about 0.1 percent to about 2.0 percent, by weight of the final composition.

63. A method according to claim 57 wherein the dopant mixture consists essentially of magnesium, calcium and lithium, and wherein the magnesium is present at a level of about 0.1 to about 0.5 percent, the calcium is present at a level of about 0.1 to about 0.5 percent, and the lithium is present at a level of about 0.1 to about 0.5 percent by weight of the final composition.

64. A method according to claim 57 wherein the dopant mixture consists essentially of magnesium, calcium and sodium, and wherein the magnesium is present at a level of about 0.1 to about 0.5 percent, the calcium is present at a level of about 0.1 to about 0.5 percent, and the sodium is present at a level of about 0.1 to about 0.5 percent by weight of the final composition.

65. A method according to claim 57 wherein the dopant mixture consists essentially of magnesium, calcium and potassium, and wherein the magnesium is present at a level of about 0.1 to about 0.5 percent, the calcium is present at a level of about 0.1 to about 0.5 percent, and the potassium is present at a level of about 0.1 percent to about 1.0 percent, by weight of the composition.

66. A method according to claim 57 wherein the dopant consists essentially of magnesium, calcium, lithium, sodium and potassium, and wherein said magnesium is present at a level of about 0.1 to about 0.5 percent, said calcium is present at a level of about 0.1 to about 0.5 percent, said lithium is present at a level of about 0.1 to about 0.5 percent, said sodium is present at a level of about 0.1 percent to about 0.5 percent, and said potassium is present at a level of about 0.1 percent to about 1.0 percent, by weight of the final composition.

* * * * *